US012111112B2

(12) United States Patent
Runk et al.

(10) Patent No.: US 12,111,112 B2
(45) Date of Patent: Oct. 8, 2024

(54) TWO-CIRCUIT EVAPORATORS

(71) Applicant: MAHLE International GmbH, Stuttgart (DE)

(72) Inventors: Robert Louis Runk, Lockport, NY (US); Donald Robert Pautler, East Amherst, NY (US); Timothy John Filonczuk, Williamsville, NY (US); Longhu Li, Williamsville, NY (US)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 17/684,565

(22) Filed: Mar. 2, 2022

(65) Prior Publication Data

US 2023/0280102 A1 Sep. 7, 2023

(51) Int. Cl.

| | |
|---|---|
| ***F28D 1/053*** | (2006.01) |
| ***F28F 1/02*** | (2006.01) |
| ***F28F 9/02*** | (2006.01) |
| *F28D 21/00* | (2006.01) |

(52) U.S. Cl.

CPC ..... *F28D 1/05391* (2013.01); *F28F 1/02* (2013.01); *F28F 9/0221* (2013.01); *F28D 2021/0073* (2013.01); *F28D 2021/0085* (2013.01)

(58) Field of Classification Search

CPC ..... F28D 1/0408; F28D 1/05391; F28D 2021/0073; F28D 2021/0085; F28F 1/02; F28F 9/0221

See application file for complete search history.

(56) References Cited

U.S. PATENT DOCUMENTS

| | | | | |
|---|---|---|---|---|
| 5,241,839 | A * | 9/1993 | Hughes | F28F 9/0278 62/515 |
| 7,571,761 | B2 * | 8/2009 | Katoh | F28F 9/0221 165/174 |
| 9,103,598 | B2 * | 8/2015 | Bellenfant | F28D 1/0408 |
| 9,625,214 | B2 * | 4/2017 | Katoh | F28F 9/0214 |
| 9,746,232 | B2 | 8/2017 | Forrest | |
| 9,909,818 | B2 | 3/2018 | Goodman et al. | |
| 10,281,223 | B2 * | 5/2019 | Hofmann | F28F 9/0278 |

(Continued)

FOREIGN PATENT DOCUMENTS

| | | |
|---|---|---|
| CN | 103644685 A | 3/2014 |
| CN | 109595951 A | 4/2019 |

(Continued)

*Primary Examiner* — Raheena R Malik
(74) *Attorney, Agent, or Firm* — Dickinson Wright PLLC

(57) ABSTRACT

A heat exchanger that includes two or more thermal circuits configured to exchange heat. The thermal circuits are located relative to one another in a configuration defined by one of the following:

i) in a stacked plate manifold that includes first and second plates configured for inlet/outlet connections and to divide fluid flow into separate tubes with the exchange of heat through a single face;

ii) in a complex manifold comprising two or more distributors that separate fluid flow into each thermal circuit with the exchange of heat through a single face; and iii) in a plurality of stacked evaporators; each evaporator comprising a plurality of coils with fins located there between, wherein the evaporators include at least one coil section in which fins are absent.

13 Claims, 3 Drawing Sheets

(56) References Cited

U.S. PATENT DOCUMENTS

| | | | | |
|---|---|---|---|---|
| 2010/0186934 | A1* | 7/2010 | Bellenfant | F28D 1/0408 165/174 |
| 2011/0056667 | A1 | 3/2011 | Taras et al. | |
| 2018/0340746 | A1 | 11/2018 | Jin et al. | |
| 2019/0049194 | A1 | 2/2019 | Yanik et al. | |
| 2022/0120504 | A1* | 4/2022 | Yamada | F28F 9/02 |

FOREIGN PATENT DOCUMENTS

| | | | |
|---|---|---|---|
| EP | 1710525 | A1 | 10/2006 |
| EP | 1762808 | A1 | 3/2007 |
| EP | 2933597 | B1 | 11/2016 |

* cited by examiner

TWO-CIRCUIT EVAPORATORS

FIELD

This disclosure relates generally to a heat exchanger or evaporator. More specifically, this disclosure relates to two-circuit evaporators.

BACKGROUND

The statements in this section merely provide background information related to the present disclosure and may not constitute prior art.

In recent years, significant research and development has focused on the efficient operation of the heat exchangers used in heating, ventilation, and air conditioning (HVAC) systems. In order to increase the efficiency of an HVAC system, a recent trend has been to use a two-circuit system in which both circuits run on a single compressor when the cooling demand is low. This system operates by constantly adjusting the compressor load and switching on a second compressor only when necessary. Thus, this system saves energy by supplying the minimum amount of cooling required at any given time. However, this type of system also gives rise to a variety of issues, such as the evaporator set-up.

One way to set up a two-circuit evaporator is to stack the circuits so that the air goes through both of them. While this set-up is compact, it is not efficient due to the presence of the double the air pressure drop, which results in a much lower efficiency for the second evaporator circuit caused by a low temperature difference between the air and the second coil.

A second way to set up a two-circuit evaporator is to put both circuits next to each other. The main issue with this type of set-up lies in that one-half of the air will by-pass the active evaporator circuit and not adequately mix with the cool air, thereby, leading to the creation of an unpredictable outlet temperature. The solution to this issue would be to block the air that flows to one-half of the evaporator set-up and to mix the air together after it passes the circuits. However, this solution will also lead to a two-circuit evaporator that is not compact in size because it requires double the width of the section in the HVAC system that houses the circuits.

Yet, another way to set up a two-circuit evaporator is to place both circuits in one core face. In this case, the heat exchanger includes two separate manifolds that lead into a plurality of separate microchannel tubes. These tubes extend parallel to each other along a first direction through one dimension of a heat exchange area. The tubes are also interspersed along a second direction that is perpendicular to the first direction. However, this type of evaporator design is complex and extremely difficult to manufacture.

Conventional ways to form a two-circuit evaporator leads to a design that is inefficient, a design that is complex and difficult to manufacture, and/or a design that is not compact in that it occupies too much space either in the HVAC system or in the associated ducting. Thus, two-circuit evaporator designs that overcome one or more of the existing deficiencies are desirable.

SUMMARY

The present disclosure generally provides a heat exchanger comprising two or more thermal circuits configured to exchange heat. The two or more thermal circuits are located relative to one another in a configuration defined by one of the following:

i) in a stacked plate manifold that includes at least a first and second plate configured for inlet and outlet connections and to divide fluid flow into separate tubes with the exchange of heat through a single face;

ii) in a complex manifold comprising two or more distributors that separate fluid flow such that fluid flows through each thermal circuit with the exchange of heat through a single face; and iii) in a plurality of stacked evaporators; each evaporator comprising a plurality of coils with fins located there between, wherein the evaporators include at least one section of the coils in which fins are absent.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

The drawings described herein are for illustration purposes only and are not intended to limit the scope of the present disclosure in any way. It should be understood that throughout the description, corresponding reference numerals indicate like or corresponding parts and features.

DETAILED DESCRIPTION

The following description is merely exemplary in nature and is in no way intended to limit the present disclosure or its application or uses. For example, the two-circuit evaporators made and used according to the teachings contained herein are described throughout the present disclosure in conjunction with a thermal circuit used in a coolant or refrigerant application in order to more fully illustrate the construction and the use thereof. The incorporation and use of such two-circuit evaporators in other applications wherein a single heat exchanger face would be desirable is contemplated not to exceed the scope of the present disclosure.

The present disclosure generally provides heat exchangers that incorporate two or more thermal circuits configured to exchange heat through a single heat exchanger face. These heat exchanger designs are compact in size, exhibit high efficiency, and are capable of providing substantial mixing of the outlet air. These heat exchanger designs lower the energy required to keep spaces at a desired temperature. The at least two thermal circuits are located relative to one another and to the single face in the heat exchanger in a configuration defined by one of the geometries shown in FIGS. 1-3 as further described herein.

Figure 1:
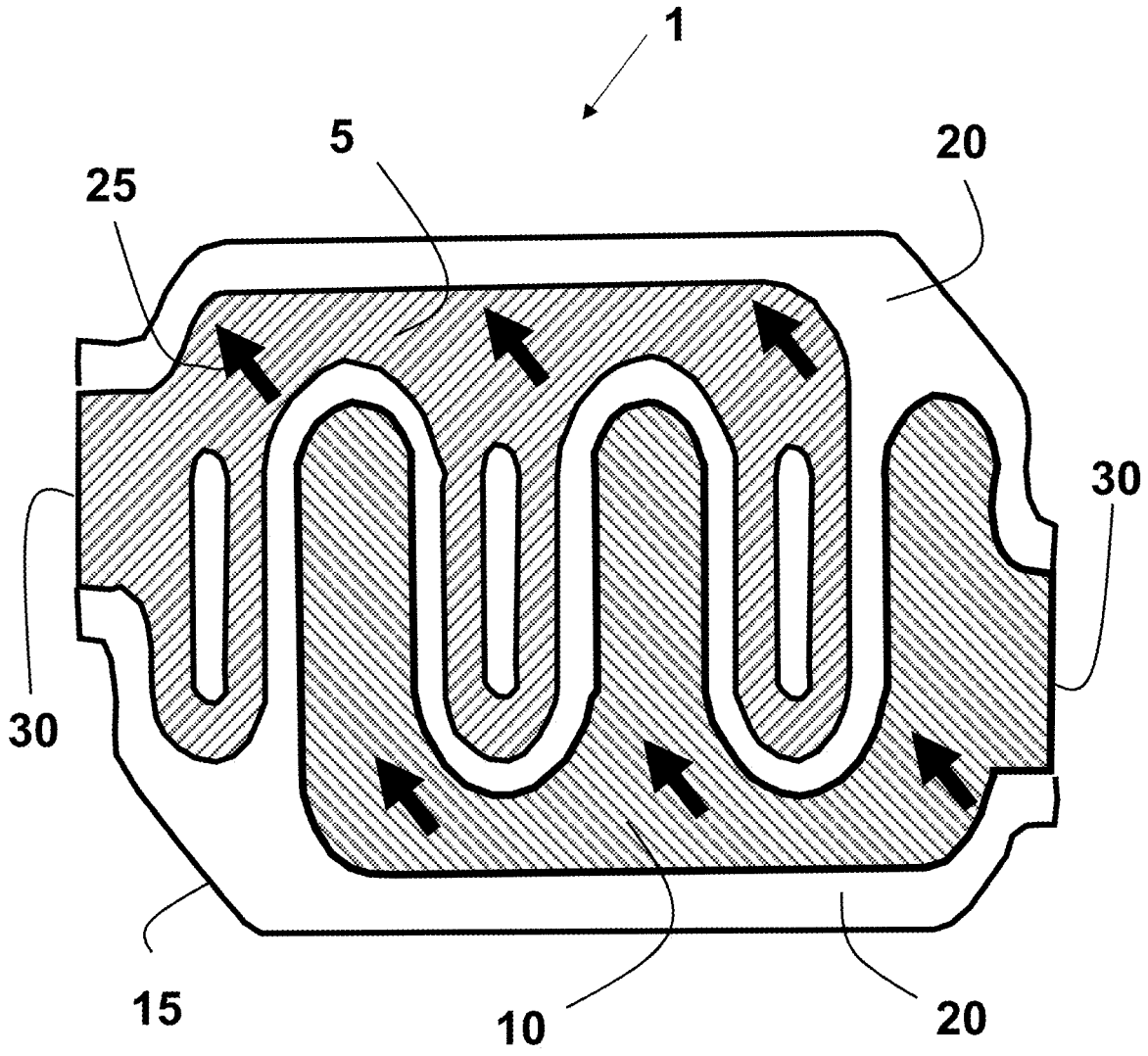
FIG. 1 is a schematic representation of an end view for a two-circuit evaporator design having a single face formed using a stacked plate manifold according to the teachings of the present disclosure.

Referring to FIG. 1, according to one aspect of the present disclosure, the single face heat exchanger 1 may incorporate two or more thermal circuits 5, 10 having inlets/outlets 30 within a stacked plate manifold 15. Since FIG. 1 is an end view of the plate configuration the flow paths 25 through the thermal circuits 5, 10 are perpendicular to the drawing. Alternatively, the number of thermal circuits 5, 10 in the evaporator is two.

Still referring to FIG. 1, the stacked plate manifold 15 shown in said figure includes three plates with only the second or middle plate 20 being visible. This manifold 15 also includes a first or base plate (not shown) that is located below the middle plate 20 through which all of tubes go through and a third or top plate (not shown) that is located above the middle plate 10 without tube slots in order to seal the manifold 15. The middle plate 20 keeps the flow from the different tubes that form the thermal circuits 5, 10 from mixing. The use of another number of plates, such as, without limitation, two plates or 4 plates, in the stacked plate manifold is possible without exceeding the scope of the present disclosure. When only 2 two plates are used in the stacked manifold, the elimination of the middle plate would require that each of the two plates be formed with features embedded therein. In a design with 4 plates, the two thermal circuits 5, 10 may exist in different levels, which could provide for an enhanced sealing capability. The stacked plate manifold also may divide fluid flow into each separate tube; alternatively, into every other tube, alternatively into every two or more tubes; alternatively, into every two or three tubes.

When necessary or desirable, the first or base plate in the stack may be brazed to the tubes. The second plate 20 may be machined and/or stamped into a shape configured to make connection with the inlet/outlet 30, as well as to maintain separate thermal circuits 5, 10. Alternatively, the second plate 20 may also be formed as two or more partial plates, e.g., split into second and third plates, in order to simplify production thereof. Prior to use, the two or more partial plates would be fastened together in order to form the second plate.

Figure 2:
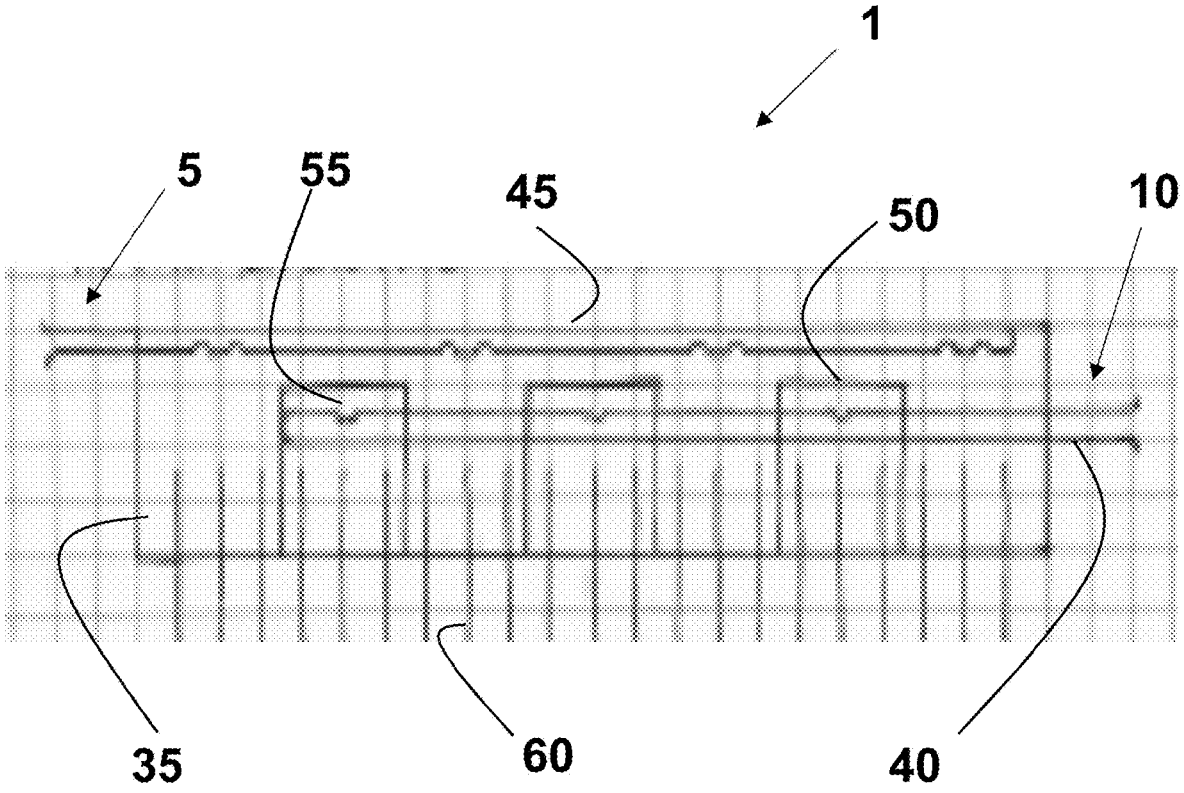
FIG. 2 is a schematic representation of another two-circuit evaporator design having a single face and two distributors that direct fluid flow within a manifold according to another aspect of the present disclosure.

According to another aspect of the present disclosure, a second single face heat exchanger 1 as shown in FIG. 2 includes two or more thermal circuits 5, 10 located therein. This heat exchanger 1 includes a standard manifold 35 with complex geometry inside in order to keep the flows in each circuit 5, 10 separate. This geometry consists of a first distributor 40 and a second distributor 45 with the first distributor 40 having only holes 55 inside of where manifold dividers 50 are placed. The second distributor 45 is located external to the dividers 50 and supplies the tubes 60 that are not under the dividers 50.

Still referring to FIG. 2, the overall number of tubes or groups of tubes to which the distributor provides fluid flow may vary. Alternatively, one or more of the distributors 40, 45 provides fluid flow to groups of three to four tubes in each section. The manifold dividers 50 may be substituted with any other known manifold separators without exceeding the scope of the present disclosure.

When necessary or desirable different manifold types may be utilized, including without limitation, the formation of a co-joined manifold from the separate manifolds. The tube is made of an uniform material or consists of a uniform material, which material preferably is a metal. The angle of the tubes may be modified to optimize performance, efficiency or compactness without exceeding the scope of the present disclosure.

Figure 3:
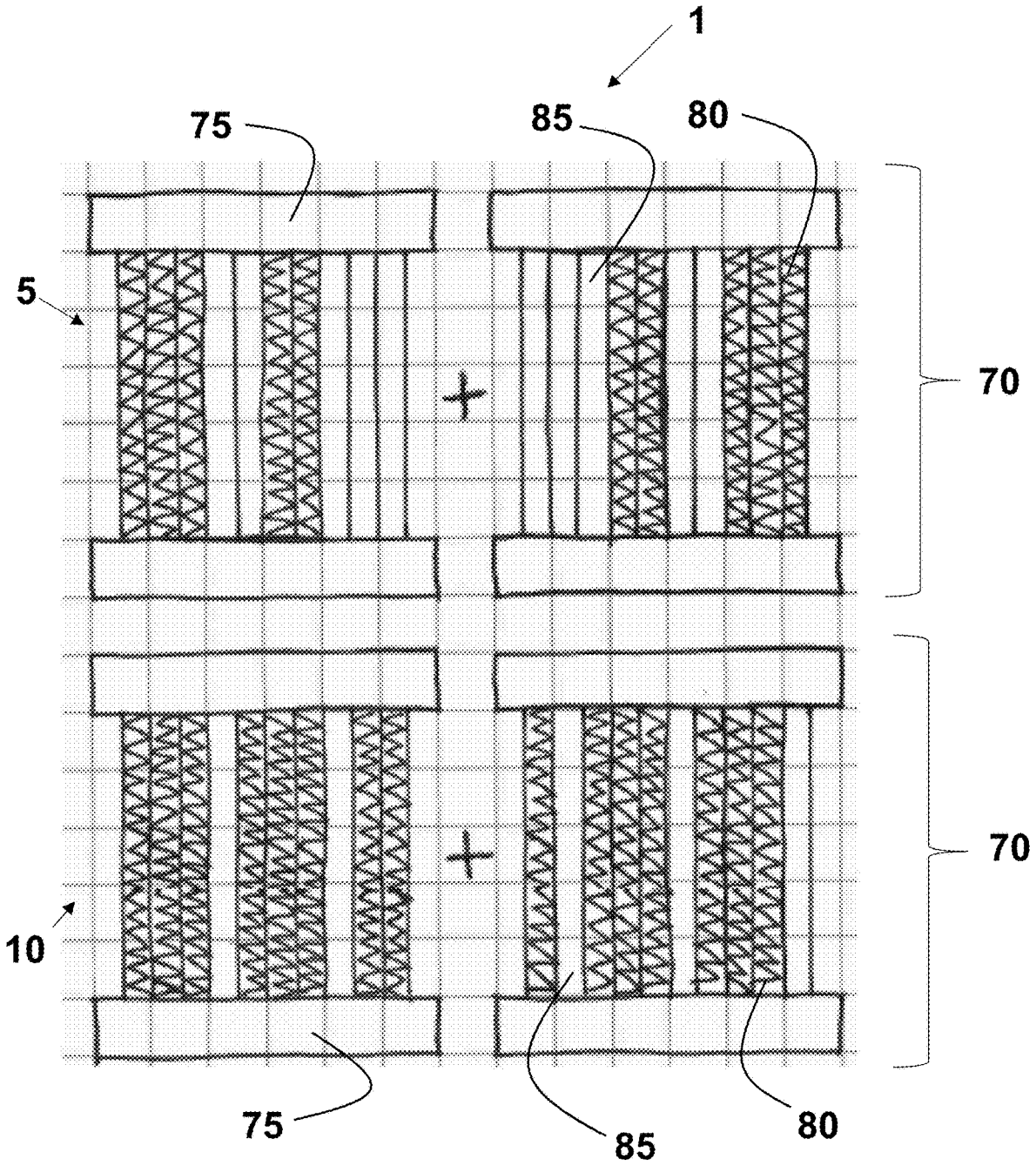
FIG. 3 is a schematic representation of yet another two-circuit evaporator design using two stacked circuits that address the air pressure drop according to another aspect of the present disclosure.

Referring now to FIG. 3, according to yet another aspect of the present disclosure, another heat exchanger 1 is shown having two or more thermal circuits 5, 10. In this case, a plurality of stacked evaporators 70 is utilized to form the heat exchanger 1. Each of the stacked evaporators 70 comprises a plurality of coils 75 with fins 80 located there between, provided that the stacked evaporators 70 include at least one section of the coils 75 in which fins are absent 85. Reducing the number of fins present in the coils is beneficial in order to address any issue with the air pressure drop through the evaporators 70. Any number or combination of centers/fins may be eliminated in order to help reduce the air pressure drop through the two or more coils. Alternatively, the stacked evaporators 70 include two or more coils.

Still referring to FIG. 3, this design requires the incorporation of at least one seal configured to ensure the air does not bypass the coils by going through the finless sections. Alternatively, each of the stacked evaporators generally includes more than one seal. The incorporation of the seals in this design makes the evaporator 1 more efficient, thereby, helping to meet application specific energy and space limitations.

For the purpose of this disclosure the terms "about" and/or "substantial" are used herein with respect to measurable values and ranges due to expected variations known to those skilled in the art (e.g., limitations and variability in measurements).

For the purpose of this disclosure, the terms "at least one" and "one or more of" an element are used interchangeably and may have the same meaning. These terms, which refer to the inclusion of a single element or a plurality of the elements, may also be represented by the suffix "(s)" at the end of the element. For example, "at least one manifold", "one or more manifolds", and "manifold(s)" may be used interchangeably and are intended to have the same meaning.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A heat exchanger, the heat exchanger configured to divide fluid flow into two or more fluidically separated thermal circuits with each of the fluidically separated thermal circuits being configured to exchange heat with air through a single continuous face; wherein the two or more fluidically separated thermal circuits are located relative to one another in a configuration defined by one of the following:

i) in a stacked plate manifold that includes at least a first and second plate configured for inlet and outlet connections and to divide fluid flow into separate tubes by forming a wall between the thermal circuits, such that the fluid flows in the same direction through the separate tubes, with the exchange of heat with the air through the single continuous face;

ii) in a complex manifold comprising two or more distributors that separate fluid flow into each thermal circuit with the exchange of heat with the air through the single continuous face; and iii) in a plurality of stacked evaporators; each evaporator comprising a plurality of coils with fins located there between, wherein the evaporators include at least one section of the coils in which fins are absent.

2. The heat exchanger according to claim 1, wherein the stacked plate manifold comprises three plates;

wherein the first plate is brazed to the tubes, the second plate is machined or stamped into a shape configured for inlet and outlet connections and to keep the two or more thermal circuits separate, and a third plate is configured to seal the stacked plate manifold.

3. The heat exchanger according to claim 1, wherein the second plate comprises two or more partial plates fastened together.

4. The heat exchanger according to claim 1, wherein the stacked plate manifold comprises greater than two plates.

5. The heat exchanger according to claim 1, wherein the stacked plate manifold provides fluid flow to every second or third tube.

6. The heat exchanger according to claim 1, wherein the two or more distributors include a first distributor having holes in which manifold dividers are placed and a second distributor located outside of the manifold dividers, wherein the second distributor provides fluid flow to tubes external to the manifold dividers.

7. The heat exchanger according to claim 6, wherein the first and second distributors provide fluid flow to groups of three or four tubes.

8. The heat exchanger according to claim 1, wherein the stacked plate manifold comprises four plates.

9. The heat exchanger according to claim 1, wherein the stacked plate manifold comprises two plates, each of the two plates being formed with features embedded therein to provide for inlet and outlet connections and to keep the two or more thermal circuits separate.

10. The heat exchanger according to claim 8, wherein the two or more thermal circuits are located in different levels within the stacked plate manifold.

11. The heat exchanger according to claim 1, wherein the stacked evaporators comprise at least two coils.

12. The heat exchanger according to claim 1, wherein each stacked evaporator further comprises one or more seals configured to prevent fluid from by-passing the coils by flowing through the at least one finless section.

13. Two or more fluidically separated thermal circuits for use in a heat exchanger according to claim 1, wherein the fluidically separated thermal circuits are configured to exchange heat through a single continuous face.

* * * * *